US005598596A

United States Patent [19]

Jones et al.

[11] Patent Number: 5,598,596

[45] Date of Patent: Feb. 4, 1997

[54] RESILIENT CLUB

[75] Inventors: Michael R. Jones; Linda S. Jones, both of 37859 Clark Creek Rd., Burney, Calif. 96013

[73] Assignees: Michael R. Jones; Linda S. Jones, both of Burney, Calif.

[21] Appl. No.: 252,617

[22] Filed: May 31, 1994

[51] Int. Cl.[6] ..... A47L 13/16; A47L 13/40; A47L 13/46; A63H 33/30

[52] U.S. Cl. ..... 15/1.52; 15/209.1; 15/231; 15/244.3; 15/247; 446/473; 482/12; 463/47.2; 473/564

[58] Field of Search ..... 15/1.52, 208, 209.1, 15/228, 231, 232, 244.3, 247, 104, 165; 273/67 R, 84 R; 446/371, 473; 482/12, 83, 87, 90

[56] References Cited

U.S. PATENT DOCUMENTS

| | | | |
|---|---|---|---|
| 2,029,426 | 2/1936 | Kingdon | 15/231 |
| 2,648,863 | 8/1953 | Darling | 15/231 |
| 2,940,102 | 6/1960 | Marinus | 15/209.1 |
| 2,987,317 | 6/1961 | Acevedo | 273/84 R |
| 3,083,392 | 4/1963 | Sewell | 15/231 |
| 3,358,313 | 12/1967 | Grimes, Sr. | 15/231 |
| 3,793,668 | 2/1974 | Olson | 15/247 |
| 4,099,288 | 7/1978 | Rittenbaum et al. | 15/228 |
| 5,154,431 | 10/1992 | Hayashi et al. | 273/411 |
| 5,295,926 | 3/1994 | Tanabe | 446/473 |
| 5,343,587 | 9/1994 | Findley | 15/231 |

FOREIGN PATENT DOCUMENTS

| | | | |
|---|---|---|---|
| 620820 | 5/1961 | Canada | 15/1.52 |

*Primary Examiner*—Mark Spisich

[57] ABSTRACT

The present invention comprises a club shaped device having a removable cover which encloses substantially all of the club and is fastened thereto. In one embodiment, the club shaped device is composed of a head and a handle both constructed out of a resilient material, such as dense foam rubber. The handle has a hollow interior area which has an opening at its bottom. The edges of the removable covering are placed into the opening and a removable plug is shoved into the opening to steadfastly hold the cover's edges against the handle's inner wall. In one embodiment, the present invention is used for cleaning and dusting. In another embodiment, the present invention is used as a soft club novelty item to allow users to vent their frustration without causing injury to the items struck by the club.

7 Claims, 8 Drawing Sheets

RESILIENT CLUB

FIELD OF THE INVENTION

The present invention relates to a cleaning apparatus and stress relieving novelty item as well an item on which artwork and/or text may be displayed and more particularly relates to a resilient club shaped device with removable covers which can be used for cleaning in one embodiment, for relieving stress in another embodiment and for displaying artwork and/text in yet another embodiment.

BACKGROUND OF THE INVENTION

Hand held cleaning apparatus, such as feather dusters, cleaning cloths and sponges are known in the prior art. Feather dusters are used to dust household surfaces, but lack the ability to apply pressure to a surface to remove dried water marks or other unwanted material from the surface.

Rags, towels and sponges give the user the ability to apply pressure to a surface, but do not allow the user to easily reach around and in between many items which rest on the surface being cleaned. Further, rags, towels and sponges do not allow a user to reach surfaces or items which are beyond arm's length, such as cobwebs, the tops of cabinets and the like.

There has also been a need for a simple device which allows a user to effectively vent his or her frustration by hitting objects/people, thereby relieving the user's stress level, while not injuring the objects/people around the user which have been hit. One prior art alternative is the free standing, blow up punching doll. However, this alternative has a lag time between successive punches due to the time that it takes the doll to realign itself in a standing position and only allows for one graphic image or message to be printed on to its surface.

SUMMARY OF THE INVENTION

The present invention substantially overcomes the limitations of the prior art by providing a resilient club, or wand, shaped device which makes use of a removable covering.

More specifically, the present invention is comprised of a club shaped device having a covering of some sort, such as a sock or a piece of cloth, which is fastened to the device. In one embodiment, the club shaped device is composed of a head and a handle made of a resilient material, such as foam rubber. The removable covering then encloses substantially all of the club and is coupled thereto using any suitable coupling means, such as "Velcro" (which is a hook and loop fastener) as well as a plug. In an alternate embodiment, the handle has a hollow interior area which has an opening at the bottom of the handle. The edges of the removable covering are placed into the opening in the bottom of the handle and a removable plug is also shoved into the opening to steadfastly hold the edges against the handle's inner wall. Thus, the tension of the cover over the head and handle couples them together. Additionally, the cover tension can be achieved by pushing the plug farther into the opening in the bottom of the handle.

The present invention, thus, provides a cleaning apparatus which allows a user to clean, dust or dry surfaces and to apply pressure to the surfaces being cleaning, thereby removing hard to remove, unwanted material from a surface. The present invention also provides a means to quickly remove and replace the cleaning cover so that the device can provide optimal cleaning of a surface. Further, the present invention allows the user to extend his or her reach when cleaning surfaces. In one embodiment, the amount of extension can be lengthened by adding an extension section to the handle.

In an alternate commercial embodiment, the present invention is made out of a less dense foam rubber. This device is used to vent a person's frustration by allowing them to hit objects without causing harm to the hit objects. Text, artwork and/or political material may be placed onto the club's cover thereby allowing the user to display a picture and/or message to focus his or her frustration on a particular topic. Further, since the covers are removable, the user can select from a number of different covers to suit the user's mood.

It is therefore one object of the present invention to provide a means to clean and dust hard to reach surfaces.

It is another object of the present invention to provide an apparatus which has a removable cover.

It is a further object of the present invention to provide a means for fastening the removable covering to a resilient club or wand shaped device.

It is a still further object of the present invention to provide a hitting device which will aid people in venting frustration without harming the hit objects.

In addition, it is a further object of the present invention to provide a means for displaying artwork and/or text.

These and other objects of the invention will be better understood from the following detailed description of the inventions, taken together with the attached figures.

DETAILED DESCRIPTION OF THE INVENTION

Figure 1:
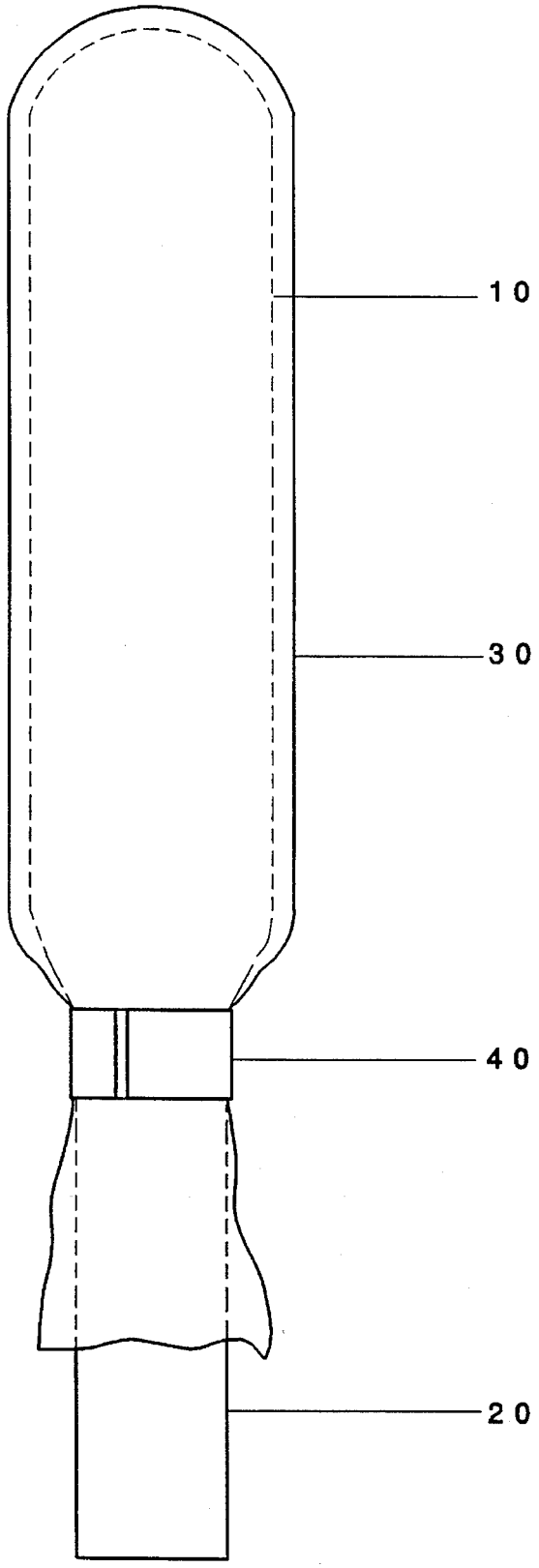
FIG. 1 is a front view of one embodiment of the present invention.
Figure 6:
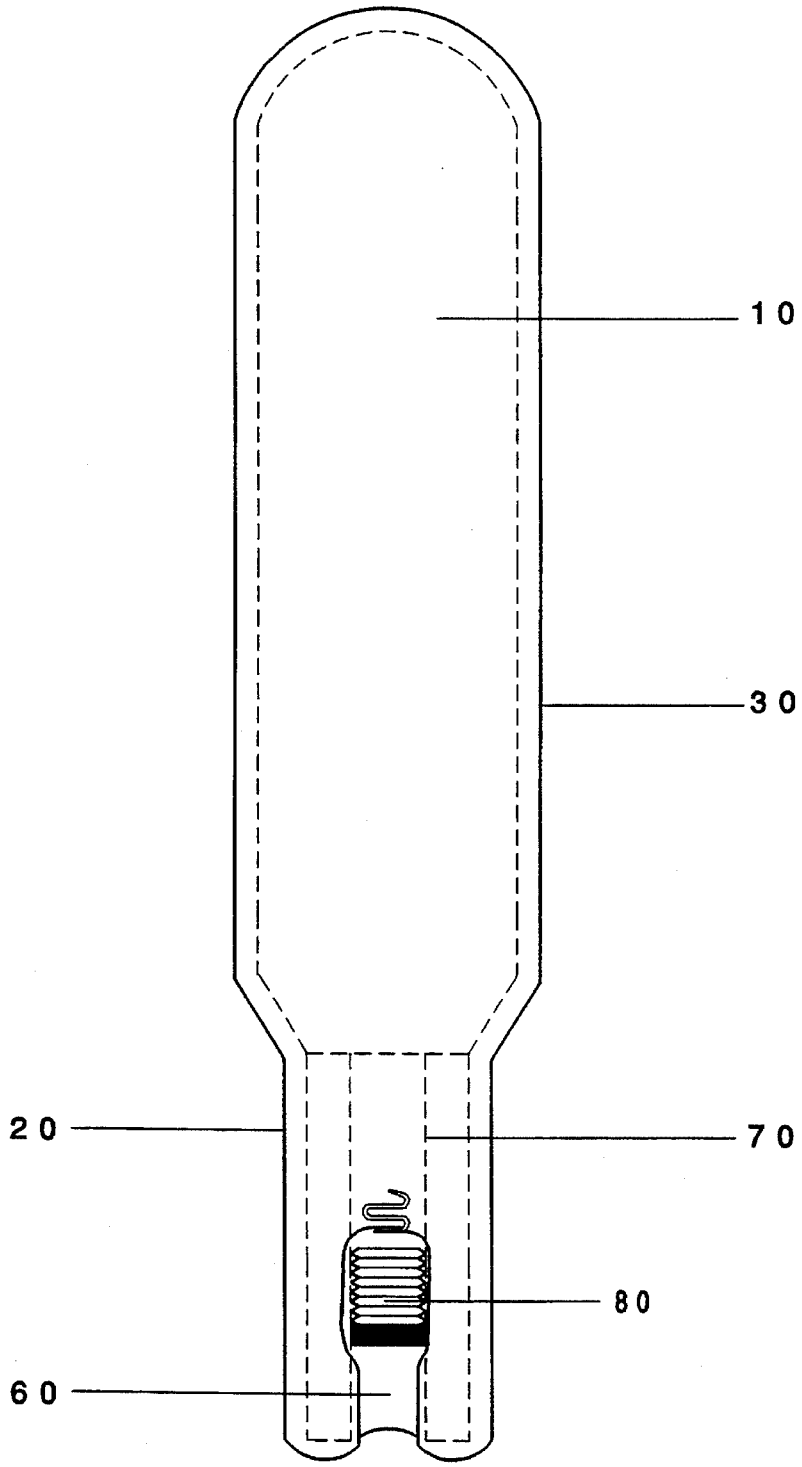
FIG. 6 is a front view of one embodiment of the present invention.

Referring first to FIG. 1, the present invention can be better appreciated. A resilient club shaped device is created out of a head 10 and a handle 20. Typically, the handle will have a smaller diameter than the head 10, so that the user can easily grip the club. Both the head and the handle will typically be made from a resilient material, such as foam rubber. The density of the resilient material used depends on the specific commercial application. However, in another embodiment where the head has a small diameter, such as for cleaning the inside of tubes or pipes, the handle could have a larger diameter so that the club may continue to be easily gripped. In FIG. 1, the head 10 and the handle 20 may be integrally coupled together. However, one skilled in the art will appreciate that the head 10 may be separate from the handle 20 and the two separate portions of the club may be coupled in a variety of different ways and still be within the spirit of the present invention. A cover 30 is positioned over the head 10 and handle 20 of the club and is fastened in place using a suitable fastening means 40, such as "Velcro", a string, a ribbon, a plug 80 as shown in FIG. 6, etc. In one embodiment, the present invention is used for cleaning, dusting, drying and polishing surfaces. The type of cover 30 is thus chosen to further that commercial use, i.e. electrostatically charges cloth, sock, cleaning cloth or chamois.

In another embodiment, the present invention is used as a soft club novelty item to allow users to vent their frustration without causing injury to the items struck by the club. The cover 30 in this embodiment is also chosen to further this commercial use, i.e. a tight knit fabric which allows messages and pictures to be applied to the outer surface.

Figure 2A:
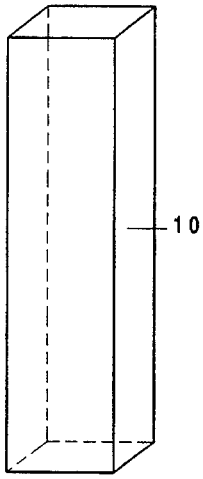
FIGS. 2(A)–2(J) are perspective views of the head according to the present invention.
Figure 2B:
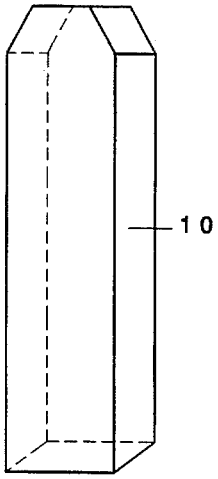
Figure 2C:
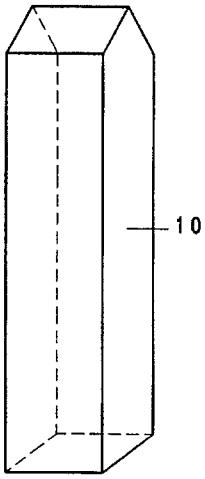
Figure 2D:
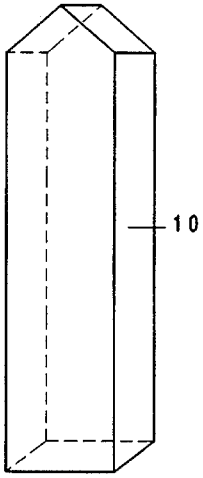
Figure 2E:
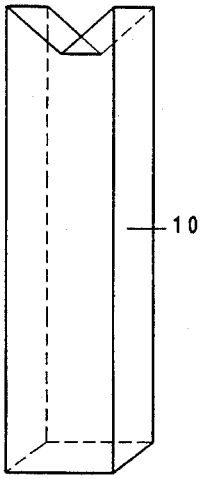
Figure 2F:
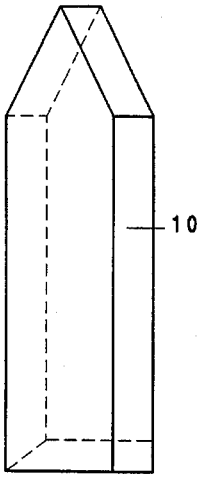
Figure 2G:
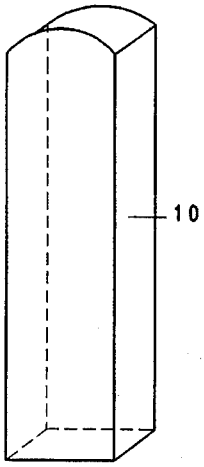
Figure 2H:
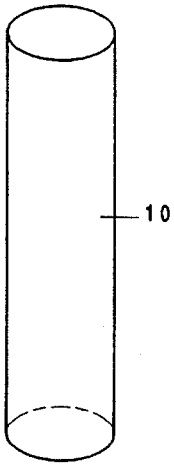
Figure 2I:
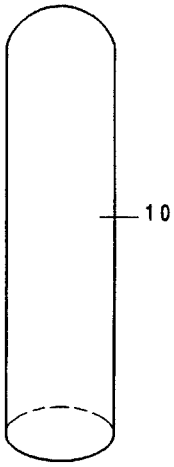
Figure 2J:
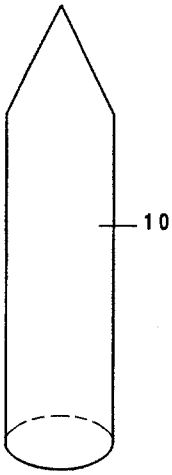

FIGS. 2(A)–2(J) show examples of possible alternative heads. FIG. 2(A) shows a long, rectangular head. FIGS. 2(B)–2(D) and 2(F) show long rectangular heads with tapered tops of varying degrees. FIG. 2(E) shows a long, rectangular head with a cut out portion at its top. FIGS. 2(H)–2(J) show a cylindrical head having flat, rounded and tapered tops, respectively. One skilled in the art will appreciate that FIGS. 2(A)–2(J) are exemplary only and that all head shapes need not be listed here or shown in the Figures.

Figure 3A:
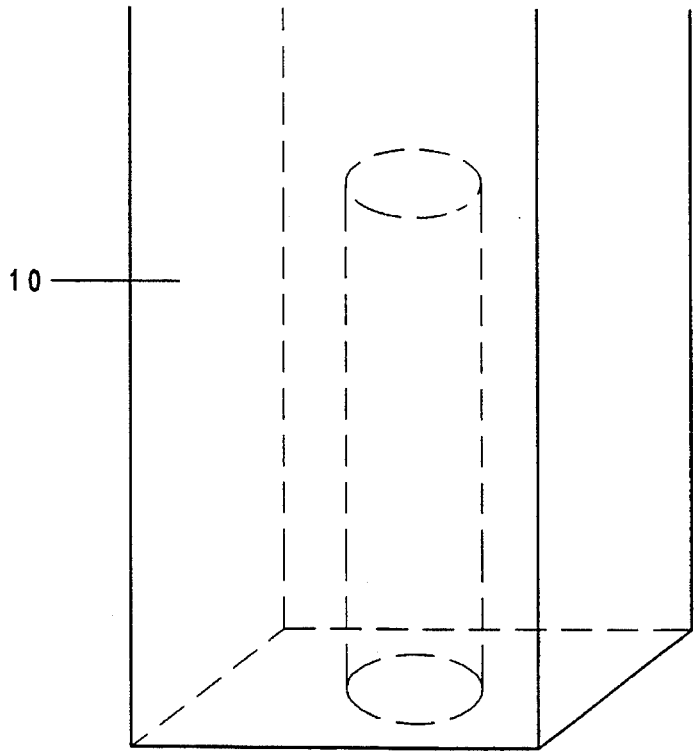
FIGS. 3(A) and 3(B) are perspective views of the bottom portion of the head portion according to the present invention.
Figure 3B:
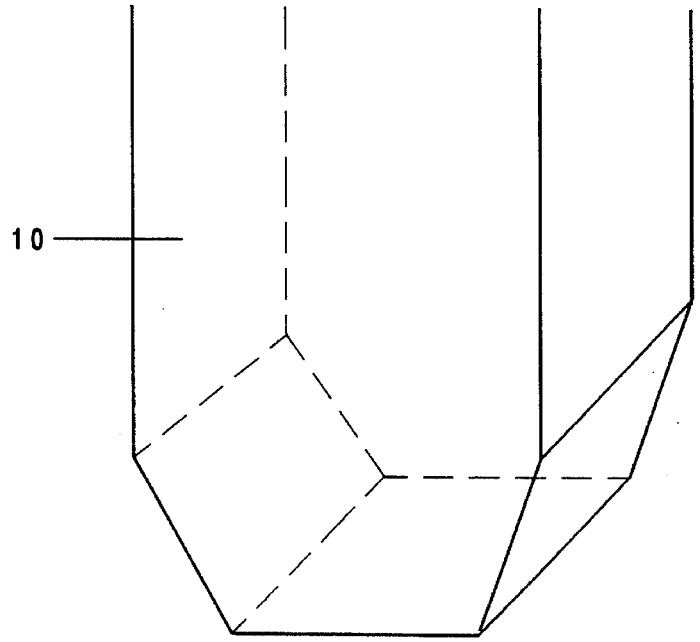
Figure 4A:
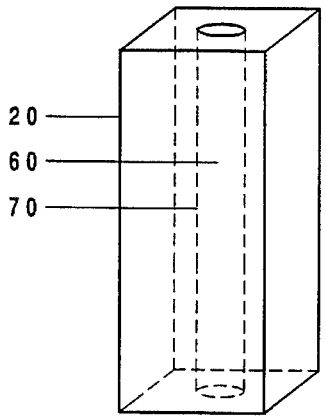
FIGS. 4(A) and 4(B) are perspective views of the handle having a hollow interior according to the present invention.
Figure 4B:
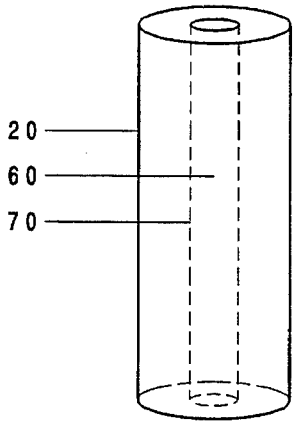

FIGS. 3(A) and 3(B) show possible variations for the bottom of the head which again are meant to be merely exemplary and not limiting. FIG. 3(A) shows a squared bottom and a partially hollow interior having an interior wall. FIG. 3(B) shows a chamfered bottom of the head. FIGS. 4(A) and 4(B) show two exemplary handles which have a hollow center area having an interior wall.

Figures 5A, 5B, 5C, 5D, 5E, 5F:
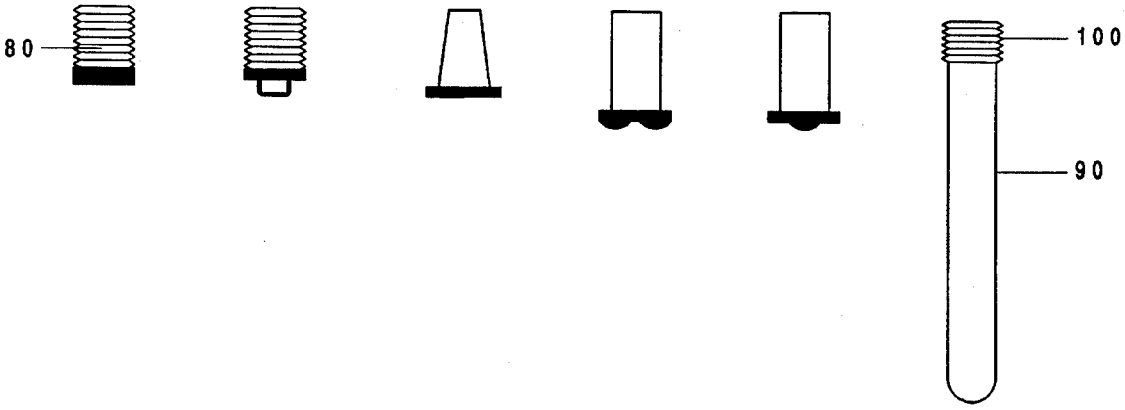
FIGS. 5(A)–5(F) are side views of plugs according to the present invention.

FIG. 5(A) shows a plug used as an alternate and presently preferred way of securing the cover to the club. Referring now to FIG. 6, the handle 20 has a hollow or at least partially hollow center area 60 further having at least one interior handle wall 70. The handle 20 is composed of a resilient material, such as foam rubber, although many other types of material could be used. The cover's edges are forced inside the hollow center area 60 and the plug 80 is then forced into the hollow center area 60. The plug has a radius which is greater than the radius of the hollow center area 60 which causes the plug 80 to push the cover outward. The cover 30 is thus frictionally secured between the plug 80 and the interior handle wall 70. Each time a user grips the resilient handle, the plug is forced slightly farther into the handle thereby tightening the cover around the club, further coupling the head 10 and handle 20 together when these comprise separate elements.

One skilled in the art will appreciate that the plug 80 may also be slightly smaller that the hollow center area 60. Once the cover's edges are forced into the hollow center area 60, the plug will have a sufficient radius to steadfastly couple the cover around the club.

FIGS. 5(B)–5(E) show alternate designs for the plug 80, shown in FIG. 6. One skilled in the art will appreciate that these Figures are not limiting on the present invention, only exemplary of the type of plugs which could be used in this embodiment. FIG. 5(F) shows a plug 100 integrally connected to rod 90. In one embodiment, this combination is attached to a head having a hollow center area, as shown in FIG. 3(A). In this embodiment, the head is made out of a resilient material, such as foam rubber. Alternately, the combination in FIG. 5(F) could be connected to the hollow center area of the handle, shown in FIG. 6, in place of the plug 80. This combination allows a user of the club to extend his or her reach.

Figure 7A:
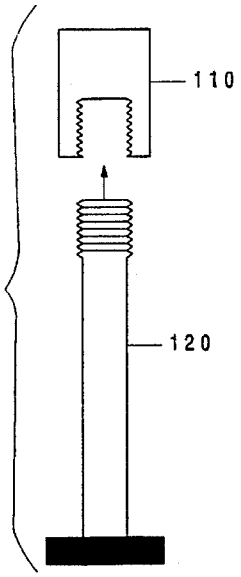
FIGS. 7(A)–7(C) are side views of a plug and removable handle combination according to the present invention.
Figure 7B:
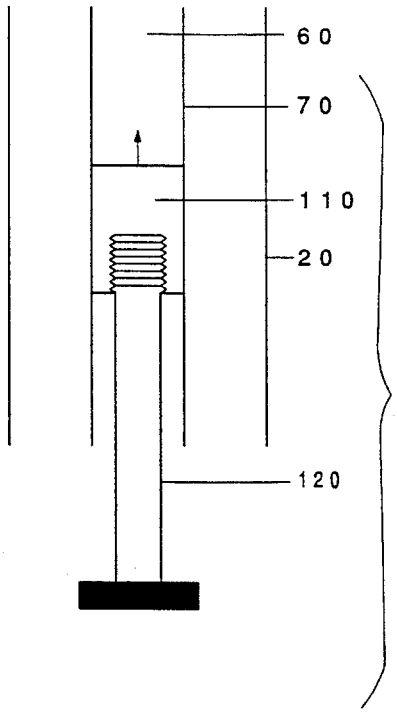
Figure 7C:
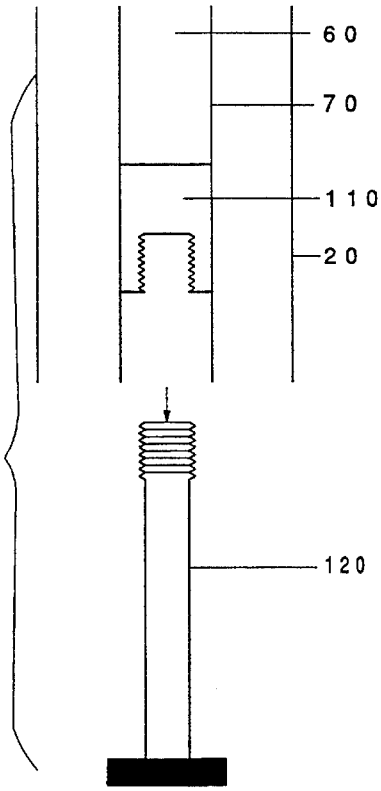

FIGS. 7(A)–7(C) show a combination of a plug 110 with at least a partially hollow center having female threads and a rod 120 having male threads. The two are coupled together using the aforementioned threads. This embodiment can also be used with a head, similar to FIG. 3(A) , or a handle, similar to FIG. 6. The combination 110,120 in this embodiment can then fasten a cover to a head or to a handle. The rod 120 can then optionally be removed if it is not needed and reattached when it is needed.

Figure 8A:
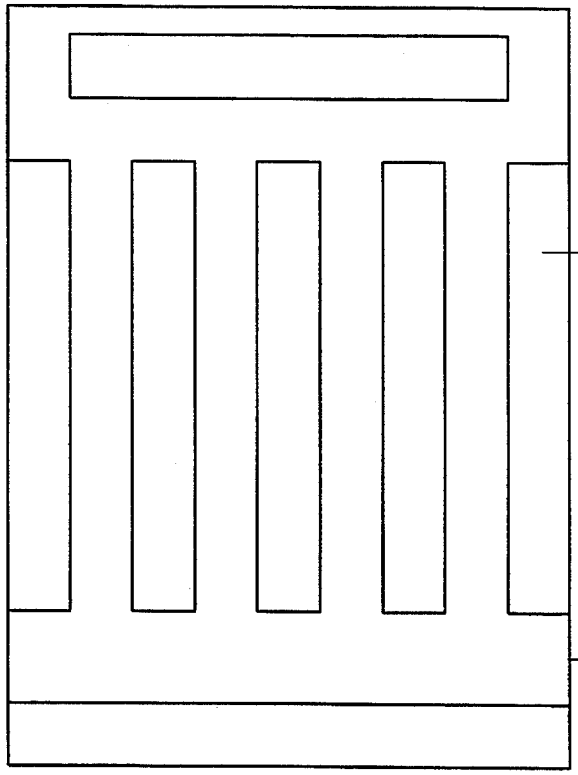
FIGS. 8(A) and 8(B) are perspective views of the club and covering according to the present invention.
Figure 8B:
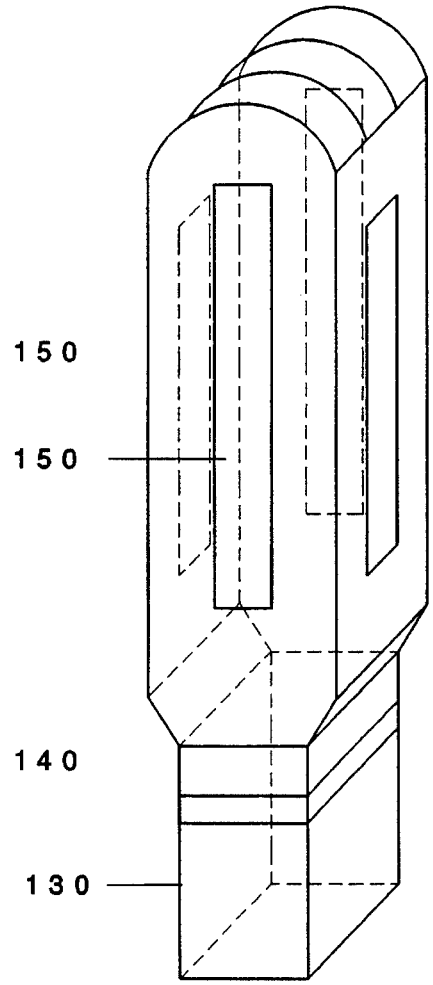

FIG. 8 shows an alternate embodiment having a club 130 and a cover 140. The cover is fastened to the club using a plurality of "Velcro" strips 150 on both the club 130 and the cover 140.

In operation, the present invention can be used as a cleaning, dusting, drying or polishing device which allows the user to quickly replace the cover as it gets too soiled to effectively clean or dust a surface. Further, the pressure can be applied to the club to remove hard to remove material from the surface being cleaned. Also, optional extension rods can be added to the club to allow a user to extend his or her reach. One skilled in the art will appreciate that varying densities of resilient material can be used to form the club. The choice of the resilient material being largely dependent of the type of cleaning or dusting to be done.

Figure 9:
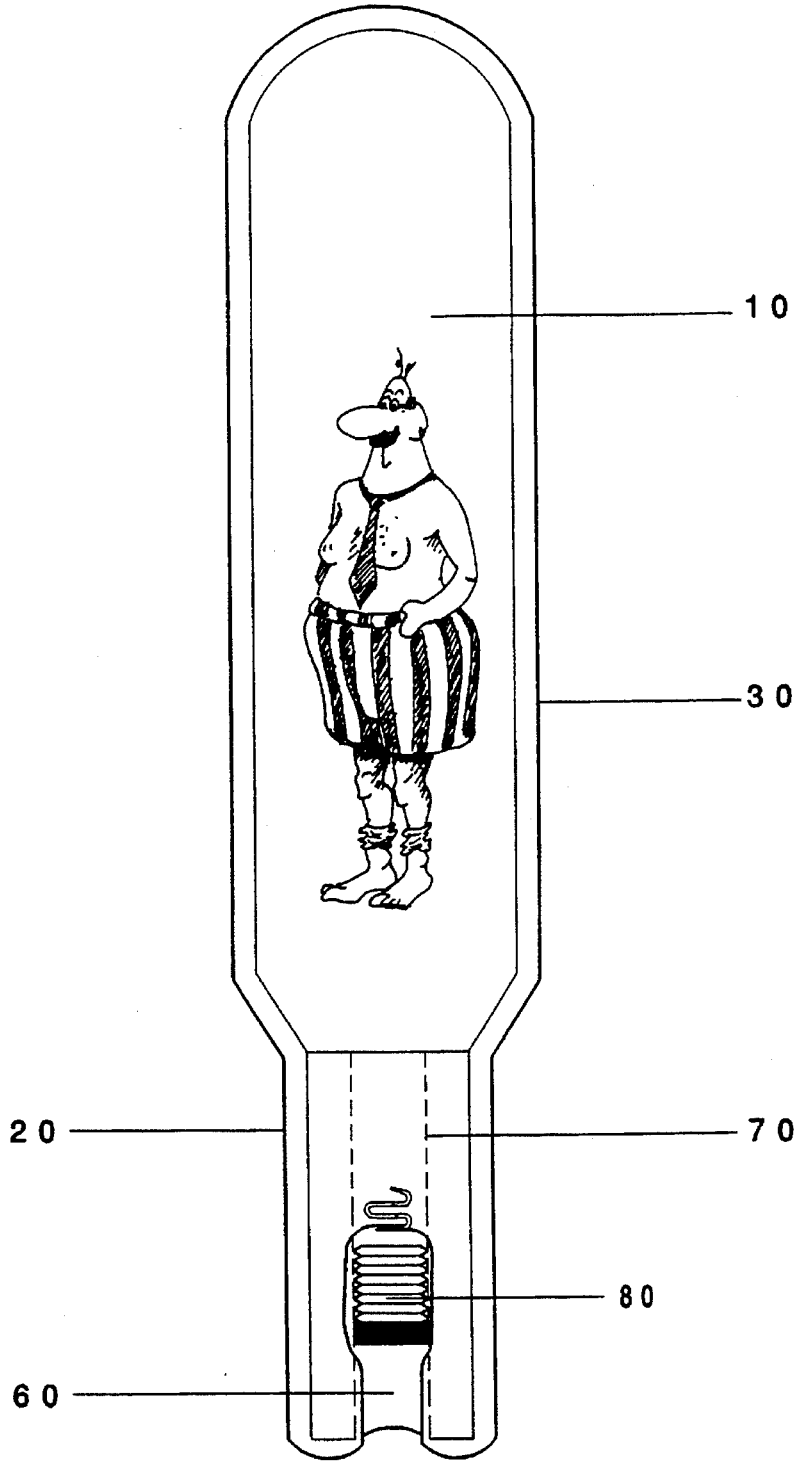
FIG. 9 is a front view of one embodiment of the present invention showing artwork which may be displayed thereon.

Alternately, the present invention can be used as a soft foam club used to vent the user's stress and frustration by allowing the user to hit objects or people without causing harm to the object or person hit. Text, artwork and/or political material, as shown in FIG. 9, can then be placed onto the club's cover thereby allowing the user to focus his or her frustration on a particular topic. Further, since the coverings are removable, the user can select from a number of different coverings to suit the user's mood.

Having fully described several embodiments of the present invention, it will be apparent to those of ordinary skill in the art that numerous alternatives and equivalents exist which do not depart from the invention set forth above. It is therefore to be understood that the present invention is not limited by the foregoing description, but only by the appended claims.

What is claimed is:

1. A resilient club, comprising:

(a) a resilient body including an upper head portion and a lower handle portion operatively connected to said upper head portion, said lower handle portion including a hollow center area opening at an end thereof;

(b) a covering material adapted to enclose said resilient body, said covering material including peripheral edges; and (c) a plug member adapted to be received in the hollow center area of the lower handle portion, said plug member retaining the edges of the covering material within said hollow center area by forcing the edges of the covering material into the hollow center area whereby the edges of the covering material are frictionally secured between the plug member and an interior wall of the hollow center area.

2. The resilient club of claim 1 wherein the upper head portion and the lower handle portion are separate elements and the upper head portion has a bottom surface and the lower handle portion has a top surface, wherein the top surface of the lower handle portion abuts the bottom surface of the upper head portion and is secured thereto by the tension applied to the covering material by the plug member.

3. The resilient club of claim 1 wherein the upper head portion and the lower handle portion of the resilient body are composed of foam rubber.

4. The resilient club of claim 1 wherein covering material is selected from the group consisting of an electrostatically charged cloth, a chamois, a sock and a cleaning fabric.

5. The resilient club of claim 1 wherein the covering material has thereon at least one of the group consisting of text and artwork.

6. The resilient club of claim 1 wherein the plug member has a hollow interior and further wherein there is an extension member adapted to be received in the hollow interior of the plug member for extending the length of the club.

7. The resilient club of claim 1 wherein the lower handle portion of the resilient body is adapted to be compressed by the user whereby the plug member is forced further into the hollow center area thus increasing the tension applied to the covering material.

* * * * *